US008806716B2

(12) United States Patent
Ducharme et al.

(10) Patent No.: US 8,806,716 B2
(45) Date of Patent: Aug. 19, 2014

(54) QUICK ASSEMBLY HINGE MECHANISM FOR JOINING FIRST AND SECOND PANEL MEMBERS

(71) Applicant: Rhinokore Composites Manufacturing Partnership, Armstrong, CA (US)

(72) Inventors: Troy Ducharme, Christ Church (BB); Blake Ducharme, Houston, TX (US)

(73) Assignee: Rhinokore Composites Manufacturing Partnership, Armstrong, British Columbia (CA)

( * ) Notice: Subject to any disclaimer, the term of this patent is extended or adjusted under 35 U.S.C. 154(b) by 0 days.

(21) Appl. No.: 13/984,822

(22) PCT Filed: Feb. 22, 2013

(86) PCT No.: PCT/CA2013/000168

§ 371 (c)(1),
(2), (4) Date: Aug. 9, 2013

(87) PCT Pub. No.: WO2013/126988

PCT Pub. Date: Sep. 6, 2013

(65) Prior Publication Data

US 2014/0101890 A1 Apr. 17, 2014

Related U.S. Application Data

(60) Provisional application No. 61/606,078, filed on Mar. 2, 2012.

(51) Int. Cl.
*E05D 7/10* (2006.01)

(52) U.S. Cl.
USPC ..... 16/267; 16/252; 16/387; 16/390; 16/266

(58) Field of Classification Search
USPC ..... 16/266, 267, 268, 269, 225, 386, 387, 16/254, 262; 220/826, 840, 841, 842, 743, 220/844, 908, 4.22, 4.23
See application file for complete search history.

(56) References Cited

U.S. PATENT DOCUMENTS 771,654 A * 10/1904 Meek ..... 16/267
1,578,408 A * 3/1926 Diday ..... 16/267

(Continued)

FOREIGN PATENT DOCUMENTS

FR 2389748 A * 1/1979

OTHER PUBLICATIONS

International Search Report and Written Opinion regarding PCT Application No. PCT/CA2013/000168 dated May 14, 2013.

*Primary Examiner* — Chuck Mah
(74) *Attorney, Agent, or Firm* — Wong, Cabello, Lutsch, Rutherford & Brucculeri, LLP.

(57) ABSTRACT

A quick assembly hinge for joining first and second panels. The hinge comprises a first wing portion securable to the first panel, a second wing portion securable to the second panel, a pin mounted to the first wing portion and a hook mounted to the second wing portion. The pin is generally parallel to the first panel when the first wing portion is secured thereto. When the second wing portion is secured to the second panel, the opening of the hook bowl is directed downwardly toward the bottom surface of the second panel. With the panels generally co-planar and their respective edges adjacent to one another the hook is receivable over at least a portion of the pin. As the first panel is rotated upwardly to form a generally a right angle with the second panel the pin is rotatable within the hook bowl preventing the lateral and vertical displacement of the panels.

8 Claims, 6 Drawing Sheets

(56) References Cited

U.S. PATENT DOCUMENTS

| | | | | | |
|---|---|---|---|---|---|
| 1,640,525 | A | * | 8/1927 | Belliveau | 16/390 |
| 2,209,659 | A | | 7/1940 | Mercer | |
| 2,268,669 | A | * | 1/1942 | Moore | 160/229.1 |
| 2,618,809 | A | * | 11/1952 | Rubinoff | 16/267 |
| 4,357,736 | A | | 11/1982 | Karpisek | |
| 4,984,333 | A | | 1/1991 | Karpisek | |
| D372,852 | S | * | 8/1996 | Noll et al. | D8/328 |
| 6,003,203 | A | * | 12/1999 | Fowlston | 16/225 |
| 6,041,846 | A | * | 3/2000 | Langlois | 160/201 |
| 6,336,249 | B1 | * | 1/2002 | Plumley | 16/225 |
| 6,834,416 | B2 | * | 12/2004 | Wang et al. | 16/266 |
| 7,797,795 | B2 | | 9/2010 | Maatta et al. | |
| 8,584,319 | B1 | * | 11/2013 | Ludin et al. | 16/266 |
| 2011/0099755 | A1 | | 5/2011 | Reichel | |

* cited by examiner

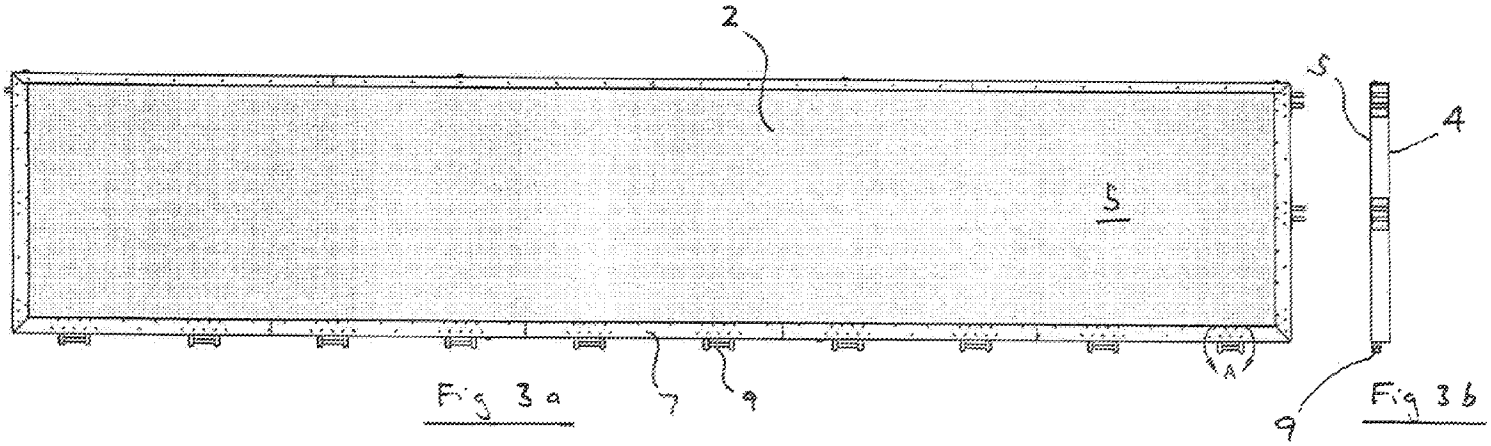
Fig 3b
Fig 3a
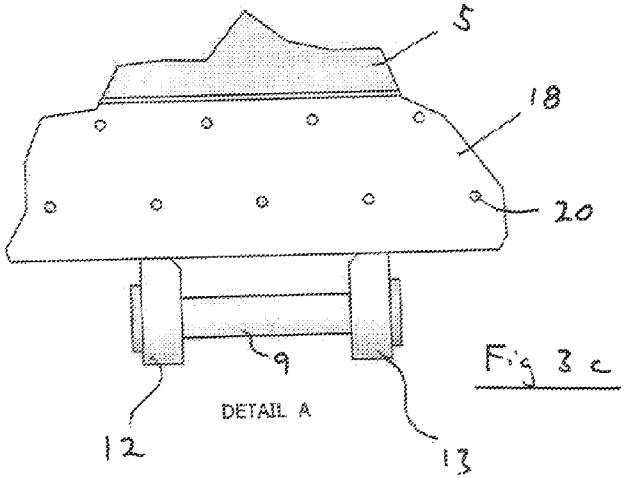
Fig 3c
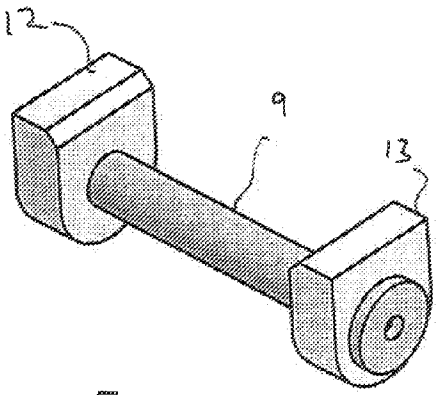
Fig 3d

QUICK ASSEMBLY HINGE MECHANISM FOR JOINING FIRST AND SECOND PANEL MEMBERS

FIELD OF THE INVENTION

This invention relates generally to a quick assembly hinge mechanism that may be used to join together first and second panel members. In one particular embodiment the invention relates to such a hinge for joining composite panels that may be used to form a containment tank or vessel.

BACKGROUND OF THE INVENTION

Portable or semi-permanent containment tanks, enclosures or vessels are commonly used in the oil and gas industry, in the mining and mineral processing industries, and for a wide variety of other industries and industrial applications. Such tanks or enclosures are often used to store slurries and/or liquids until such time as they can be further processed or otherwise collected and shipped to other locations. One such temporary containment vessel is used in association with oil and gas drilling. When drilling an oil or gas well drilling mud typically will contain toxic and/or expensive additives that cannot be released into the environment, or that for economic reasons need to be recovered. In such instances as the drilling mud leaves the casing is directed to a tank or containment vessel, after which it can be recycled back into the drilling circuit or gathered and shipped for processing, disposal or re-use.

Since in many instances containment tanks, vessels or enclosures such as those described above, are required on a temporary or semi-permanent basis they are sometimes formed from pre-made panels that are transported to the desired location and assembled on site. U.S. patent application Ser. No. 12/355,827 (Publication No. US 2012/0031899) describes an example of one such panel that may be utilized to form such a containment tank.

In an attempt to minimize the number of panels required to form a containment tank or vessel, and to also help minimize the expense of assembling the tank on site, the panels used to form the tank are typically of a considerable size, often in or around 8 feet in width by 40 feet in length. Such panels generally approach the maximum size that can be easily transported on a standard flatbed trailer. Where the panels are made from a foam filled composite material they typically can have thicknesses ranging from 3 to 6 inches and have weight in excess of 2000 pounds each. Panels made from other materials can have weights exceeding 2000 pounds. It will thus be appreciated that even though a smaller number of larger panels is easier to assemble than a greater number of smaller panels, large panels require the use of forklifts, boom trucks, small cranes, etc. in order to lift, position and manipulate them into their proper location. For example, when assembling the wall portions of the tank or enclosure, it has traditionally been necessary to bolt channels onto the floor sections and then use a crane or boom truck to lower the wall portions into position with their edges received within or adjacent to the channels. While such a mechanism has been effective, it can be tedious and time-consuming, particularly in situations where the panels are assembled in cold environments and where workers must deal with the effects of snow, ice and below freezing temperatures.

There is therefore a continuing need to improve the mechanisms available for the assembly of such tanks or enclosures in order to help minimize the time, labour and expense involved in the assembly process. At the same time there is a need to present a strong structural junction between the wall and floor portions of the tank or enclosure to ensure that there is no accidental separation which could result in a loss of containment, added expense and potential environmental damage.

SUMMARY OF THE INVENTION

The invention therefore provides a quick hinge assembly that addresses a number of the deficiencies in the prior art.

Accordingly, in one of its aspects the invention provides a quick assembly hinge mechanism for joining first and second panel members having top and bottom surfaces, the hinge mechanism comprising a first wing portion securable to a first edge of the first panel member; a second wing portion securable to a first edge of the second panel member; a pin member mounted to said first wing portion, said pin member generally parallel to the first edge of the first panel member when said first wing portion is secured thereto; a hook member mounted to said second wing portion, when said second wing portion secured to the second panel member the opening of the bowl of said hook member directed generally downwardly toward the plane of the bottom surface of the second panel member; when said first and second panel members generally co-planar with said respective first edges adjacent to one another said hook member receivable over at least a portion of said pin member, such that when the first panel member is rotated upwardly to form a generally a right angle with the second panel member said pin member rotatable within said hook bowl and preventing the lateral and vertical displacement of the first and second edges of the panel members.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which:

FIG. 3*a* is a bottom view of the first panel member of the tank shown in FIG. 1.

FIG. 3*b* is a side elevational view of the panel member of FIG. 3*a*.

FIG. 3*c* is an enlarged detail view of portion "A" of FIG. 3*a*.

FIG. 3*d* is an enlarged side perspective view of the pin member shown in FIG. 3*a*.

DETAILED DESCRIPTION OF THE DRAWINGS

The present invention may be embodied in a number of different forms. The specification and drawings that follow describe and disclose some of the specific forms of the invention.

Figure 1:
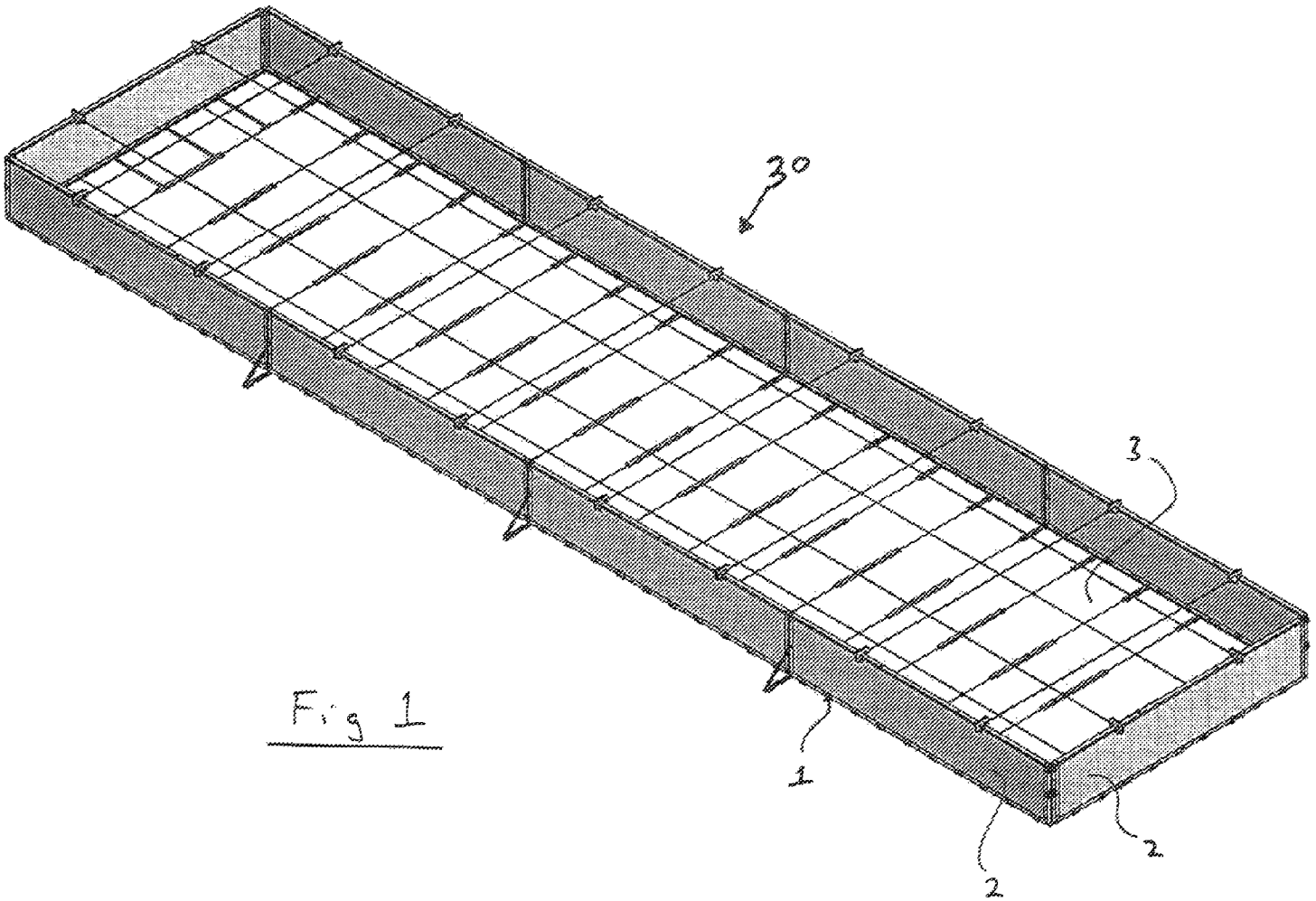
FIG. 1 is an upper perspective schematic view of a tank or containment vessel constructed utilizing the quick assembly hinge of the present invention.
Figure 2:
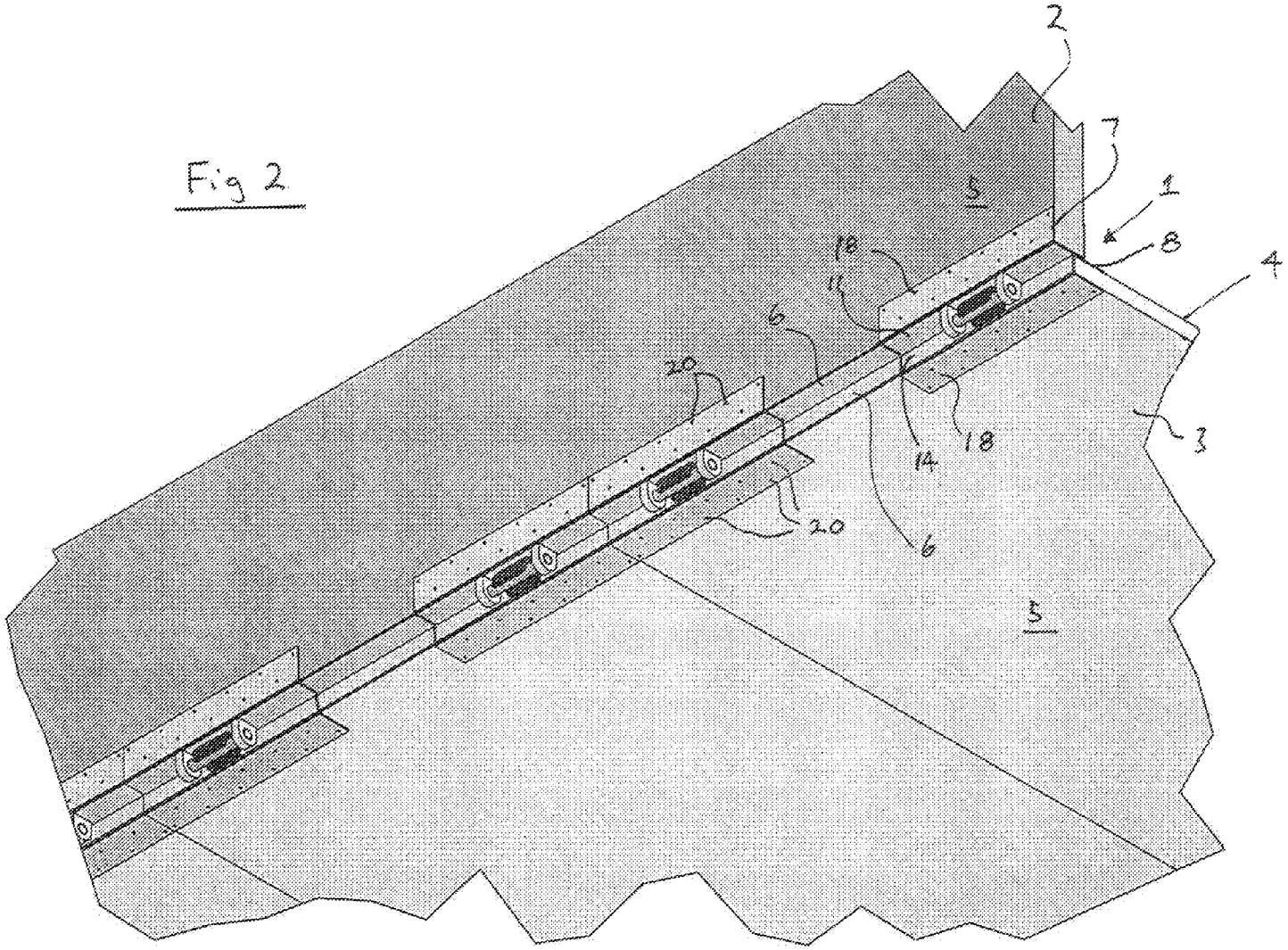
FIG. 2 is an enlarged bottom perspective view of the corner of the tank or containment vessel shown in FIG. 1.

With reference to the enclosed drawings there is shown in FIG. 1 a quick assembly hinge mechanism 1 for use in joining together first and second panel members (2 and 3 respectively). Panel members 2 and 3 are generally rectangular shaped panels having top surfaces 4, bottom surfaces 5 and edge surfaces 6. It will be appreciated from a thorough understanding of the invention that panels 2 and 3 could be of a very wide variety of different constructions. However, in one embodiment of the invention the panels are comprised of a composite material formed from a foam filled honeycomb structure with top and bottom resin filed sheets, as is described in U.S. Pat. No. 8,062,728. In the exemplary embodiment of the invention shown in FIG. 1, panels 2 and 3 are used to form a tank or containment vessel 30.

Regardless of the structure of panels 2 and 3, hinge mechanism 1 is comprised generally of a first wing portion 7, a second wing portion 8, a pin member 9 and a hook member 10. First wing portion 7 is securable to a first edge of first panel 2 while second wing portion 8 is similarly securable to a first edge of second panel 3. In a preferred embodiment of the invention, second panel 3 forms part of the bottom or floor of a containment vessel or chamber, whereas first panel 2 forms part of the vessel's wall. Pin member 9 is mounted to the first wing portion 7 such that the pin is effectively mounted or secured to the first panel. In the embodiment of the invention shown in the attached drawings the pin member is mounted to a central spine 11 of the first wing portion through the use of a pair of flanges 12 and 13. The pin is also preferably generally parallel to the first edge of first panel 2 when first wing portion 7 is secured thereto.

Similarly, hook member 10 is mounted on the central spine 14 of second wing portion 8. When mounted to the second wing portion, the opening of the bowl 15 of hook member 10 is preferably directed downwardly toward the plane of the bottom surface of the second panel member. The lateral axis of hook member 10 is generally parallel to the first end of the second panel member when second wing portion 8 is secured thereto. Further, the size and general configuration of hook bowl 15 is such that it will readily accommodate the exterior surface of pin 9. To assist in the receipt of the hook member over the pin, the edges 16 and 17 of the hook bowl may be chamfered.

In the embodiment of the invention depicted in the attached drawings, the first and second wing portions are generally u-shaped, having opposed side portions 18 and 19 extending outwardly from central spines 11 and 14, respectively. As shown, side portions 18 and 19 are received over opposite sides of panel members 2 and 3 when the wing portions are secured to the panels. Securing the wing portions to the edges of the panels can involve passing fasteners 20 through the respective opposed side portions and through the panel members, and/or through the use of an adhesive placed between the wing portions and the panel members.

Figure 4A:
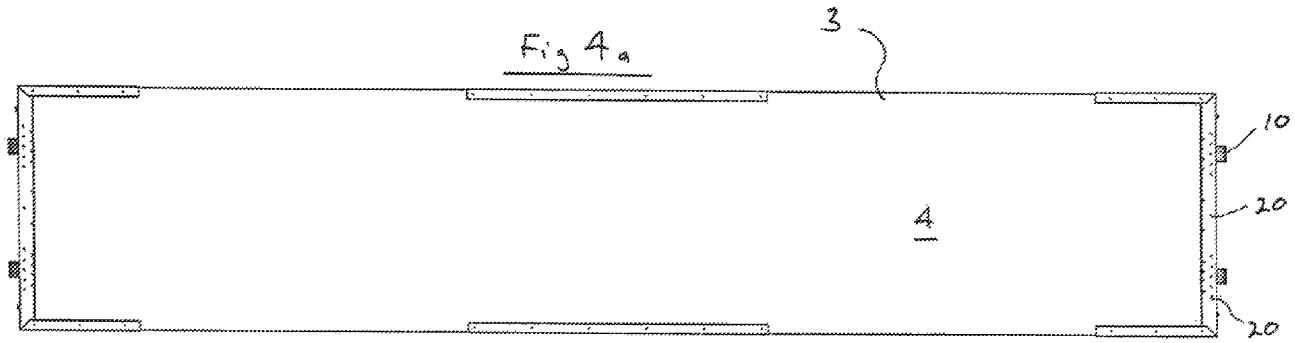
FIG. 4*a* is a bottom view of the second panel member of the tank shown in FIG. 1.
Figure 4B:
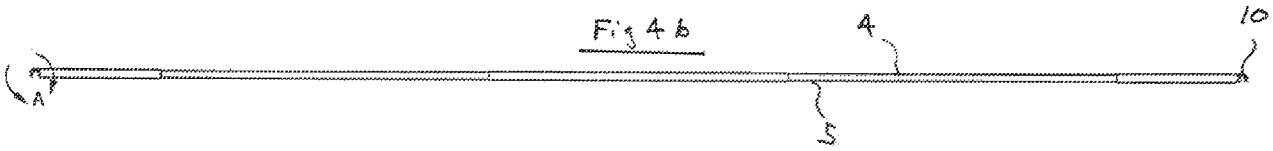
FIG. 4*b* is a side elevational view of the panel member shown in FIG. 4*a*.
Figure 4C:
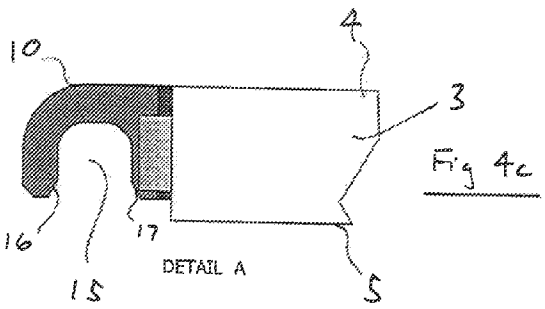
FIG. 4*c* is an enlarged detail view of portion "A" of FIG. 4*b*.
Figure 4D:
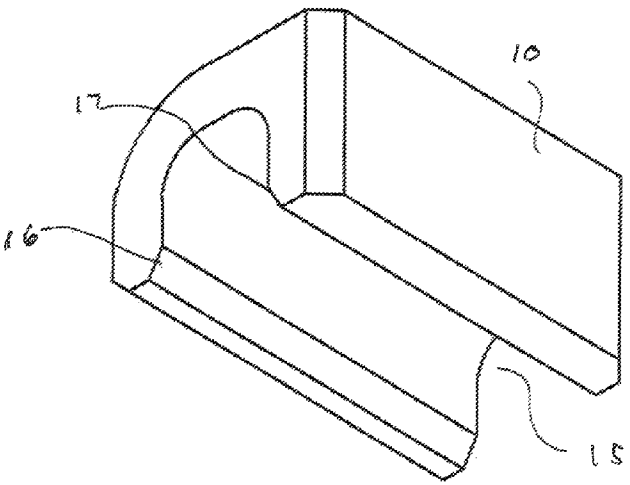
FIG. 4*d* is enlarged bottom perspective view of the hook portion shown in FIG. 4*c*.
Figure 5:
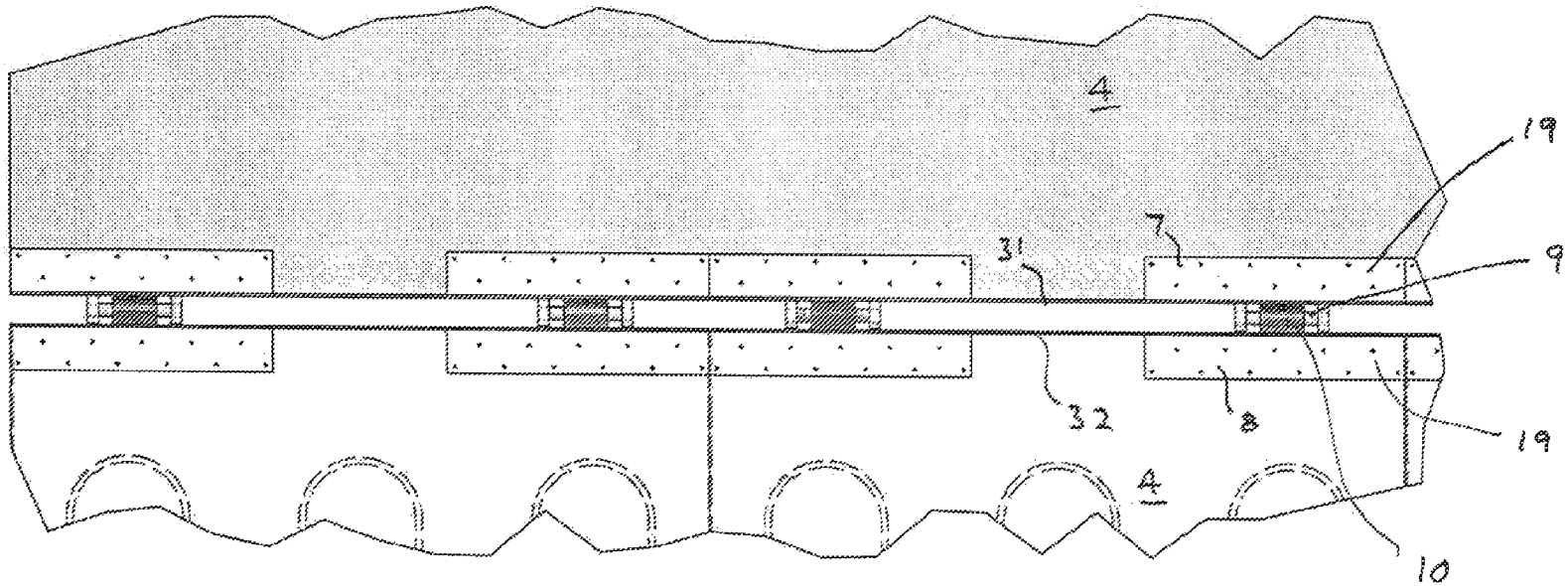
FIG. 5 is a top plan view of the first and second panel members shown connected by the quick assembly hinge mechanism of the present invention, but remaining in a co-planar configuration.

In the embodiment of the invention shown in FIG. 5, a plurality of first wing portions share a common central spine 31 and a plurality of second wing portions share a common central spine 32. In this manner a series of hinge mechanisms may be effectively mounted along the edges of the first and second panels with the individual hinge mechanisms joined along their common spines. Alternately, a series of individual and discrete hinge mechanisms may be utilized along the side surfaces of the panels. In a further alternate embodiment (and as more specifically shown in FIGS. 3*a* and 4*a*) individual hinge mechanisms may share both a common spine and common opposed side portions such that much, if not all, of edges 6 of the panels are encased by the first and second wing portions. Typically the U-shaped wing portions would be constructed from steel or another high strength and abrasion resistant metal or material. Through encasing edges 6 with the U-shaped wing portions the edges of the panels are protected from damage.

Figure 6B:
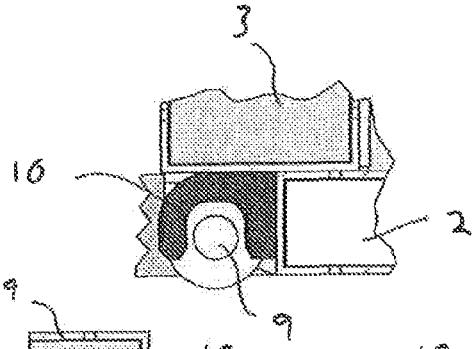
FIG. 6*b* is an enlarged cross-sectional detailed view similar to FIG. 6*a*, but with the first and second panel members rotated and perpendicular to one another.
Figure 6A:
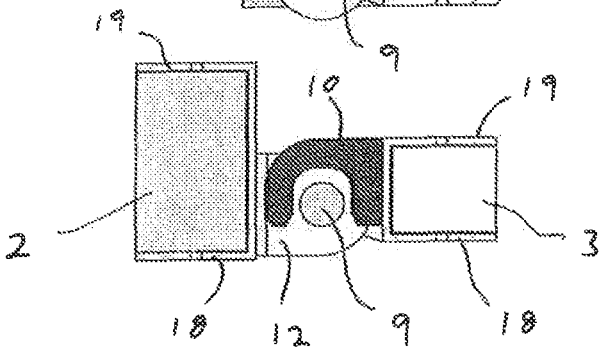
FIG. 6*a* is an enlarged cross-sectional detailed view of the hook and pin members of FIG. 5.

In accordance with the above-described structure, it will be appreciated that, in operation, when first and second panels 2 and 3 are lying generally co-planar, with their respective first edges adjacent to one another, hook member 10 may be received over at least a portion of pin member 9. Placing the hook member over the pin member will in most instances merely require positioning the second panel at the appropriate location and lowering it to the point where the hook member is received over the pin. Since the pin is rotatable within the hook bowl, first panel 2 can then be rotated upwardly relative to second panel 3 until the two panels are at an approximate right angle. In the embodiment shown in the attached drawings, the first panel is preferably thicker than the second panel such that when the two panels are generally perpendicular to one another (as described) at least a portion of the central spine of 11 of first wing portion 7 will be supported on the upper side portion 18 of the second wing portion 8. It will also be appreciated that in this embodiment pin 9 is off-centered from the middle of central spine 11 (see FIGS. 3*b* and 6*b*) and located closer to bottom surface 5 of the panel than to top surface 4. Off-centering the pin will have the tendency to allow more of the central spine 11 of the first wing portion to be supported on the upper side portion 18 of the second wing portion when the panels are perpendicular to one another. In this manner the weight of the first panel will be borne by both the second wing portion and the second panel. A solid corner between the two respective panels will also be formed which is advantageous for tank or containment vessel applications. Further, the structure of the hook member will preclude the pin member from being released from the hook bowl until such time as the panels are rotated and generally co-planar once again.

It will thus be appreciated that through the interaction of the pin and hook member, there is presented a mechanism that prevents both the lateral and vertical displacement of first panel 2 relative to second panel 1 when the panels are in a generally perpendicular orientation. That is, it will be understood that with second panel 3 being the floor of a containment vessel and first panel 2 being a wall component, the wall component will be prevented from "kicking" out, and will also be prevented from moving in a vertically upward or downward direction, to ensure the integrity of the joint between the wall and the floor. It will also be appreciated that through supporting first panel 2 upon the upper surface of the second panel 3, the weight of the first panel will not be borne by hook member 10, but will rather be distributed across the upper surface of the second panel or floor section of the tank.

The employment of the quick assembly hinge mechanism described provides a means to quickly assemble and disassemble a containment tank or vessel that is formed from a plurality of panel members. The described mechanism also provides a secure manner of joining together wall and floor panels that prevents vertical or lateral separation of the panels when under load. Through use of the novel hinge mechanism the panels may be assembled and dissembled without the use of hand tools or without having to employ bolts or other fasteners.

It is to be understood that what has been described are the preferred embodiments of the invention and that it may be possible to make variations to these embodiments. The scope of the claims should not be limited by the preferred embodiments set forth above, but should be given the broadest interpretation consistent with the description as a whole.

We claim:

1. A quick assembly hinge mechanism joining first and second panel members having top and bottom surfaces, the hinge mechanism comprising:

a generally u-shaped first wing portion having a central spine and securable to a first edge of the first panel member, said first wing portion further having opposed side portions, one of said side portions received over the top surface of the first panel member and the other one of said side portions received over the bottom surface of the first panel member;

a second generally u-shaped wing portion having a central spine and securable to a first edge of the second panel member, said second wing portion further having opposed side portions, one of said side portions received over the top surface of the second panel member and the other one of said side portions received over the bottom surface of the second panel member;

a pin member mounted to said first wing portion, said pin member generally parallel to the first edge of the first panel member when said first wing portion is secured thereto;

a hook member mounted to said second wing portion, when said second wing portion secured to the second panel member the opening of the bowl of said hook member directed generally downwardly toward the plane of the bottom surface of the second panel member, the outer edges of said hook bowl chamfered;

when said first and second panel members generally coplanar with said respective first edges adjacent to one another said hook member receivable over at least a portion of said pin member, such that (i) when the first panel member is rotated upwardly to form a generally a right angle with the second panel member said pin member rotatable within said hook bowl and limiting the lateral and vertical displacement of the first and second edges of the panel members, and (ii) at least a portion of said central spine of said first wing portion contacting said side portion of said second wing portion that is received over the upper surface of the second panel member thereby distributing the load of the first panel member to said second wing portion without distributing the load of the first panel member to said pin member.

2. The hinge mechanism as claimed in claim 1 wherein said hook bowl has a lateral axis generally parallel to the first edge of the second panel member when said second wing portion is secured thereto.

3. The hinge mechanism as claimed in claim 1 having fasteners extending through said opposite side portions and through the respective panel members to secure said wing portions to the panel members.

4. The hinge mechanism as claimed in claim 1 wherein said opposed side portions and said central spine of said wing portions are secured to the respective panel members through use of an adhesive.

5. The hinge mechanism as claimed in claim 1 wherein said pin member is mounted to said central spine of said first wing portion through use of a pair of flanges mounted to said central spine.

6. The hinge mechanism as claimed in claim 1 wherein said pin member is off-centered on said central spine toward the bottom surface of the first panel.

7. A plurality of hinge mechanisms as claimed in claim 1 wherein said first wing portions of said plurality of hinge mechanisms share a common central spine and said second wing portions of said plurality of hinge mechanisms share a common central spine.

8. The plurality of hinge mechanisms as claimed in claim 7 wherein said first wing portions share common opposed side portions and said second wing portions share common opposed side portions.

* * * * *